US006702018B2

(12) United States Patent
McGregor et al.

(10) Patent No.: US 6,702,018 B2
(45) Date of Patent: Mar. 9, 2004

(54) APPARATUS AND METHOD FOR GRAVEL PACKING AN INTERVAL OF A WELLBORE

(75) Inventors: Ronald W. McGregor, Carrollton, TX (US); Travis T. Hailey, Sugar Land, TX (US); William David Henderson, Tioga, TX (US); Robert L. Crow, Irving, TX (US); Philip D. Nguyen, Duncan, OK (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/927,217

(22) Filed: Aug. 10, 2001

(65) Prior Publication Data

US 2002/0125007 A1 Sep. 12, 2002

Related U.S. Application Data

(63) Continuation-in-part of application No. 09/800,199, filed on Mar. 6, 2001.

(51) Int. Cl.[7] ..... E21B 43/04; E21B 43/08
(52) U.S. Cl. ..... 166/278; 166/227; 166/51
(58) Field of Search ..... 166/51, 276, 278, 166/227, 228

(56) References Cited

U.S. PATENT DOCUMENTS

| | | | |
|---|---|---|---|
| 1,975,162 | A | 10/1934 | Layne |
| 2,342,913 | A | 2/1944 | Williams et al. |
| 2,344,909 | A | 3/1944 | Williams et al. |
| 4,102,395 | A | 7/1978 | Robinson |

(List continued on next page.)

FOREIGN PATENT DOCUMENTS

| | | | |
|---|---|---|---|
| EP | 1 132 571 | 9/2001 | ..... E21B/43/267 |
| WO | WO 99/12630 | 3/1999 | ..... B01D/29/15 |
| WO | WO 00/61913 | 10/2000 | ..... E21B/43/04 |
| WO | WO 01/14691 | 3/2001 | ..... E21B/43/08 |
| WO | WO 01/44619 | 6/2001 | ..... E21B/43/04 |
| WO | WO 02/10554 | 2/2002 | ..... E21B/43/26 |

OTHER PUBLICATIONS

"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.

"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar., 2001.

(List continued on next page.)

*Primary Examiner*—David Bagnell
*Assistant Examiner*—Jennifer R Dougherty
(74) *Attorney, Agent, or Firm*—Lawrence R. Youst; Paul I. Herman

(57) ABSTRACT

An apparatus and method for gravel packing an interval of a wellbore comprises an outer tubular (110), which forms a first annulus with the wellbore, and an inner tubular (114) disposed within the outer tubular (110) forming a second annulus therebetween. Within the second annulus is an axially extending production pathway (190) and an axially extending slurry passageway (194), which is defined between a channel (170) and the inner tubular (114). The outer tubular (110) has outlets (128) that are substantially aligned with outlets (178) of the channel (170). The portions of both the outer and inner tubulars (110, 114) adjacent the production pathway (190) have openings (122, 146). When a fluid slurry containing gravel is injected through the slurry passageway (194), the fluid slurry exits through the outlets (178, 128) leaving gravel in the first annulus, thereby gravel packing the interval.

53 Claims, 9 Drawing Sheets

U.S. PATENT DOCUMENTS

| | | | | |
|---|---|---|---|---|
| 4,558,742 | A | | 12/1985 | Huang et al. |
| 4,932,474 | A | | 6/1990 | Schroeder, Jr. et al. |
| 4,945,991 | A | | 8/1990 | Jones ..... 166/278 |
| 5,082,052 | A | | 1/1992 | Jones et al. ..... 166/51 |
| 5,113,935 | A | | 5/1992 | Jones et al. ..... 166/51 |
| 5,161,613 | A | | 11/1992 | Jones ..... 166/242 |
| 5,161,618 | A | | 11/1992 | Jones et al. ..... 166/308 |
| 5,165,476 | A | * | 11/1992 | Jones ..... 166/278 |
| 5,333,688 | A | | 8/1994 | Jones et al. ..... 166/278 |
| 5,355,956 | A | | 10/1994 | Restarick ..... 166/296 |
| 5,390,966 | A | | 2/1995 | Cox et al. ..... 285/137.1 |
| 5,419,394 | A | | 5/1995 | Jones ..... 166/51 |
| 5,443,117 | A | | 8/1995 | Ross ..... 166/51 |
| 5,476,143 | A | | 12/1995 | Sparlin et al. ..... 166/233 |
| 5,515,915 | A | | 5/1996 | Jones et al. ..... 166/51 |
| 5,588,487 | A | | 12/1996 | Bryant ..... 166/51 |
| 5,636,691 | A | | 6/1997 | Hendrickson et al. ..... 166/278 |
| 5,755,286 | A | | 5/1998 | Ebinger ..... 166/281 |
| 5,842,516 | A | | 12/1998 | Jones ..... 166/56 |
| 5,848,645 | A | | 12/1998 | Jones ..... 166/280 |
| 5,868,200 | A | | 2/1999 | Bryant et al. ..... 166/51 |
| 5,890,533 | A | | 4/1999 | Jones ..... 166/51 |
| 5,921,318 | A | | 7/1999 | Ross ..... 166/250.17 |
| 5,934,376 | A | | 8/1999 | Nguyen et al. ..... 166/278 |
| 6,003,600 | A | | 12/1999 | Nguyen et al. ..... 166/281 |
| 6,047,773 | A | | 4/2000 | Zeltmann et al. ..... 166/281 |
| 6,059,032 | A | | 5/2000 | Jones ..... 166/278 |
| 6,116,343 | A | | 9/2000 | Van Petegem et al. ..... 166/297 |
| 6,125,933 | A | | 10/2000 | Ross ..... 166/250.01 |
| 6,220,345 | B1 | | 4/2001 | Jones et al. ..... 166/51 |
| 6,227,303 | B1 | | 5/2001 | Jones ..... 166/378 |
| 6,230,803 | B1 | | 5/2001 | Morton et al. ..... 166/278 |
| 6,343,651 | B1 | | 2/2002 | Bixenman ..... 166/278 |
| 6,450,263 | B1 | | 9/2002 | Schwendemann |
| 6,464,007 | B1 | | 10/2002 | Jones |
| 6,481,494 | B1 | * | 11/2002 | Dusterhoft et al. ..... 166/51 |
| 6,516,881 | B2 | | 2/2003 | Hailey, Jr. |
| 6,516,882 | B2 | | 2/2003 | McGregor et al. |
| 6,557,634 | B2 | | 5/2003 | Hailey, Jr. et al. |
| 6,581,689 | B2 | | 6/2003 | Hailey, Jr. |
| 6,588,506 | B2 | | 7/2003 | Jones |
| 6,588,507 | B2 | | 7/2003 | Dusterhoft et al. |

OTHER PUBLICATIONS

"Caps$^{SM}$ Concentric Annular Packing Service for Sand Control," Halliburton Energy Services, Inc., Aug., 2000.

"Caps$^{SM}$ Sand Control Service for Horizontal Completions Improves Gravel Pack Reliability and Increases Production Potential from Horizontal Completions," Halliburton Energy Services, Inc., Aug., 2000.

"Frac Pack Technology Still Evolving," Charles D. Ebinger of Ely & Associates Inc.; Oil & Gas Journal, Oct. 23, 1995.

"Mechanical Fluid–Loss Control Systems Used During Sand Control Operations," H.L. Restarick of Otis Engineering Corp., 1992.

"Sand Control Screens," Halliburton Energy Services, 1994.

* cited by examiner

APPARATUS AND METHOD FOR GRAVEL PACKING AN INTERVAL OF A WELLBORE

CROSS-REFERENCE TO RELATED PATENT APPLICATIONS

This application is a continuation-in-part application of Ser. No. 09/800,199 filed Mar. 6, 2001 entitled Apparatus and Method for Gravel Packing an Interval of a Wellbore.

TECHNICAL FIELD OF THE INVENTION

This invention relates in general to preventing the production of particulate materials through a wellbore traversing an unconsolidated or loosely consolidated subterranean formation and, in particular to, an apparatus and method for obtaining a substantially complete gravel pack within an interval of the wellbore.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Prior art devices and methods have been developed which attempt to overcome this sand bridge problem. For example, attempts have been made to use devices having perforated shunt tubes or bypass conduits that extend along the length of the sand control screen to provide an alternate path for the fluid slurry around the sand bridge. It has been found, however, that shunt tubes installed on the exterior of sand control screens are susceptible to damage during installation and may fail during a gravel pack operation. In addition, it has been found, that it is difficult and time consuming to make all of the necessary fluid connections between the numerous joints of shunt tubes required for typical production intervals.

Therefore a need has arisen for an apparatus and method for gravel packing a production interval traversed by a wellbore that overcomes the problems created by sand bridges. A need has also arisen for such an apparatus that is not susceptible to damage during installation or failure during use. Further, a need has arisen for such an apparatus that is not difficult or time consuming to assemble.

SUMMARY OF THE INVENTION

The present invention disclosed herein comprises an apparatus and method for gravel packing a production interval of a wellbore that traverses an unconsolidated or loosely consolidated formation that overcomes the problems created by the development of a sand bridge between a sand control screen and the wellbore. Importantly, the apparatus of the present invention is not susceptible to damage during installation or failure during use and is not difficult or time consuming to assemble.

The apparatus for gravel packing an interval of a wellbore of the present invention comprises an outer tubular forming a first annulus with the wellbore and an inner tubular disposed within the outer tubular forming a second annulus therebetween. Typically, the inner tubular is positioned around a sand control screen. Together, the sand control screen and the apparatus of the present invention are assembled at the surface and run downhole to a location proximate the production interval. A portion of the side wall of the outer tubular is an axially extending production section that includes a plurality of openings. Another portion of the side wall of the outer tubular is an axially extending nonproduction section that includes one or more outlets. Similarly, a portion of the side wall of the inner tubular is an axially extending production section that is substantially circumferentially aligned with the production section of the outer tubular. Another portion of the side wall of the inner tubular is an axially extending nonproduction section that is substantially radially aligned with the nonproduction section of the outer tubular. The production section of the inner tubular has a plurality of openings therethrough, but the nonproduction section of the inner tubular has no openings therethrough.

In the volume within the second annulus between the nonproduction sections of the outer and inner tubulars there is a channel that defines an axially extending slurry passageway with the nonproduction section of the inner tubular. The volume within the second annulus between the production sections of the outer and inner tubulars is an axially extending production pathway. The channel prevents fluid communication between the production pathway and the slurry passageway. In addition, isolation members at either end of a section of the apparatus of the present invention define the axial boundaries of the production pathway.

As such, when a fluid slurry containing gravel is injected through the slurry passageway, the fluid slurry exits the slurry passageway through outlets in the channel and the outer tubular leaving a first portion of the gravel in the first annulus. Thereafter, the fluid slurry enters the openings in the outer tubular leaving a second portion of the gravel in the production pathway. Thus, when formation fluids are produced, the formation fluids travel radially through the production pathway by entering the production pathway through the openings in the outer tubular and exiting the production pathway through the openings in the inner tubular. The formation fluids pass through the first portion of the gravel in the first annulus prior to entry into the production pathway, which contains the second portion of the gravel, both of which filter out the particulate materials in the formation fluids. Formation fluids are prevented, however, from traveling radially through the slurry passageway as there are no openings in the nonproduction section of the inner tubular.

In a typical gravel packing operation using the apparatus for gravel packing an interval of a wellbore of the present invention, the first annulus between the outer tubular and the wellbore may serve as a primary path for delivery of a fluid slurry. This region serves as the primary path as it provides the path of least resistance to the flow of the fluid slurry. When the primary path becomes blocked by sand bridge formation, the production pathway of the present invention serves as a secondary path for delivery of the fluid slurry. The production pathway serves as the secondary path as it provides the path of second least resistance to the flow of the fluid slurry. When the primary and secondary paths become blocked by sand bridge formation, the slurry passageway serves as a tertiary path for delivery of the fluid slurry. The slurry passageway serves as the tertiary path as it provides the path of greatest resistance to the flow of the fluid slurry but is least likely to have sand bridge formation therein due to the high velocity of the fluid slurry flowing therethrough.

Commonly, more than one section of the apparatus for gravel packing an interval of a wellbore must be coupled together to achieve a length sufficient to gravel pack an entire production interval. In such cases, multiple sections of the apparatus of the present invention are coupled together, for example, via a threaded connection. Also, in such cases, the slurry passageways of the various sections are in fluid communication with one another allowing an injected fluid slurry to flow from one such apparatus to the next, while the production pathways of the various sections are in fluid isolation from one another.

In a method for gravel packing an interval of a wellbore of the present invention, the method comprises providing a wellbore that traverses a formation, either open hole or cased, perforating the casing, in the cased hole embodiment, proximate the formation to form a plurality of perforations, locating a sand control screen within the wellbore proximate the formation, positioning the gravel packing apparatus around the sand control screen to form a first annulus between the gravel packing apparatus and the wellbore, injecting a fluid slurry containing gravel through the slurry passageway such that the fluid slurry exits through the outlets of the channels and the outer tubular into the first annulus, depositing a first portion of the gravel in the first annulus, depositing a second portion of the gravel in the production pathway by returning a portion of the fluid slurry through openings in the outer tubular and terminating the injection when the first annulus and the production pathway are substantially completely packed with gravel.

In addition to injecting the fluid slurry containing gravel through the slurry passageway, in some embodiments, the fluid slurry may also be injected down the first annulus. In this case, the method also involves injecting a fluid slurry containing gravel into a primary path defined by the first annulus, diverting the fluid slurry containing gravel into a secondary path defined by the production pathway if the primary path becomes blocked, diverting the fluid slurry containing gravel into a tertiary path defined by the slurry passageway if the primary and secondary paths become blocked and terminating the injecting when the interval is substantially completely packed with the gravel.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
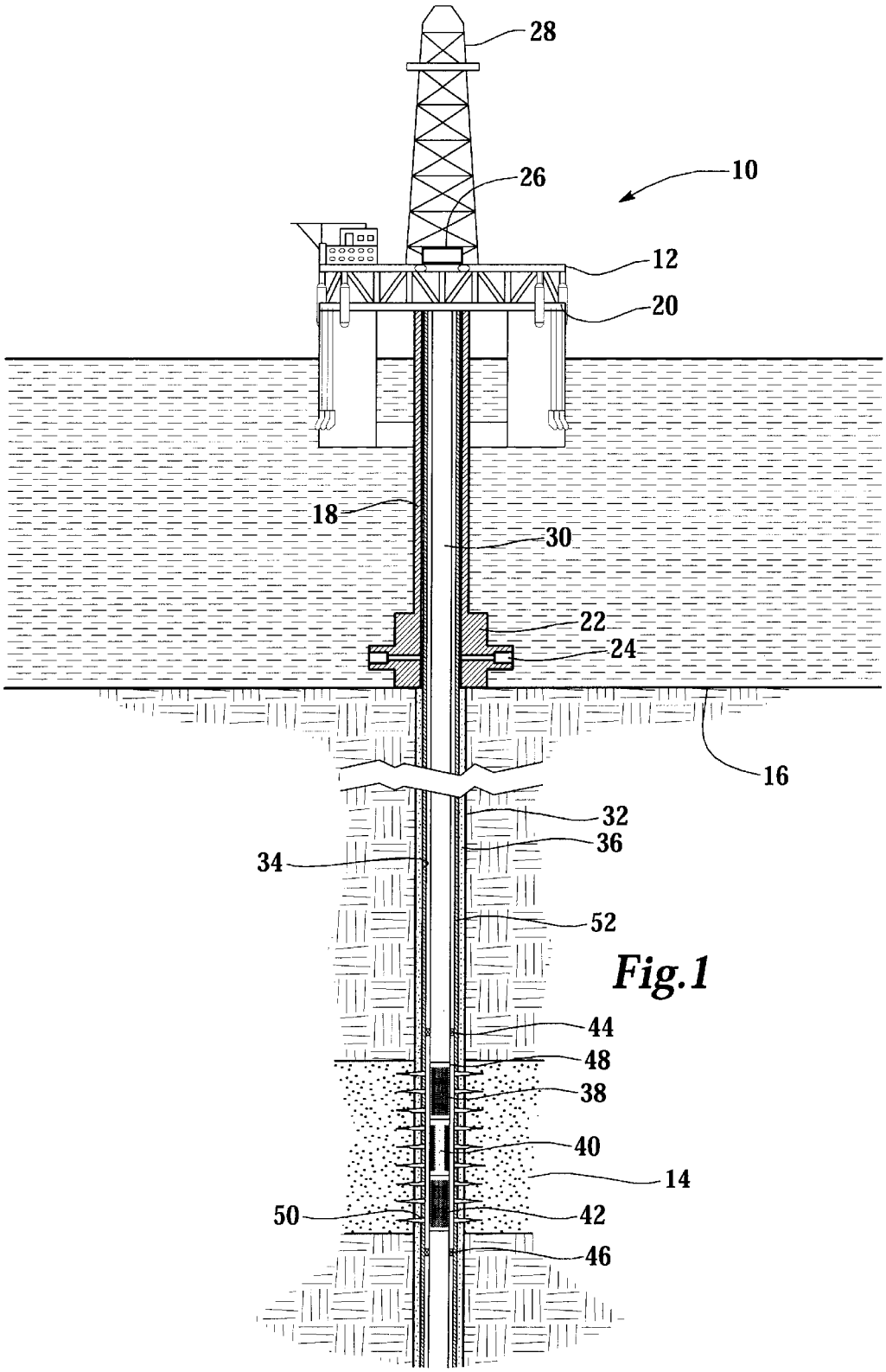
FIG. 1 is a schematic illustration of an offshore oil and gas platform operating an apparatus for gravel packing an interval of a wellbore of the present invention.

Referring initially to FIG. 1, several apparatuses for gravel packing an interval of a wellbore operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within wellbore 32 by cement 36. Work string 30 includes various tools including apparatuses 38, 40, 42 for gravel packing an interval of wellbore 32 adjacent to formation 14 between packers 44, 46 and into annular region 48. When it is desired to gravel pack annular region 48, work string 30 is lowered through casing 34 until apparatuses 38, 40, 42 are positioned adjacent to formation 14 including perforations 50. Thereafter, a fluid slurry including a liquid carrier and a particulate material such as gravel is pumped down work string 30.

As explained in more detail below, the fluid slurry may be injected entirely into apparatus 38 and sequentially flow through apparatuses 40, 42. During this process, portions of the fluid slurry exit each apparatus 38, 40, 42 such that the fluid slurry enters annular region 48. Once in annular region 48, a portion the gravel in the fluid slurry is deposited therein. Some of the liquid carrier may enter formation 14 through perforation 50 while the remainder of the fluid carrier, along with some of the gravel, reenters certain sections of apparatuses 38, 40, 42 depositing gravel in those sections. As a sand control screen (not pictured) is positioned within apparatuses 38, 40, 42, the gravel remaining in the fluid slurry is disallowed from further migration. The liquid carrier, however, can travel through the sand control screen, into work string 30 and up to the surface in a known manner, such as through a wash pipe and into the annulus 52 above packer 44. The fluid slurry is pumped down work string 30 through apparatuses 38, 40, 42 until annular section 48 surrounding apparatuses 38, 40, 42 and portions of apparatuses 38, 40, 42 are filled with gravel.

Alternatively, instead of injecting the entire stream of fluid slurry into apparatuses 38, 40, 42, all or a portion of the fluid slurry could be injected directly into annular region 48 in a known manner such as through a crossover tool (not pictured) which allows the slurry to travel from the interior of work string 30 to the exterior of work string 30. Again, once this portion of the fluid slurry is in annular region 48, a portion the gravel in the fluid slurry is deposited in annular region 48. Some of the liquid carrier may enter formation 14 through perforation 50 while the remainder of the fluid carrier along with some of the gravel enters certain sections of apparatuses 38, 40, 42 filling those sections with gravel. The sand control screen (not pictured) within apparatuses 38, 40, 42 disallows further migration of the gravel but allows the liquid carrier to travel therethrough into work string 30 and up to the surface. If the fluid slurry is injected directly into annular region 48 and a sand bridge forms, the fluid slurry is diverted into apparatuses 38, 40, 42 to bypass this sand bridge such that a complete pack can nonetheless be achieved. The fluid slurry entering apparatuses 38, 40, 42 may enter apparatuses 38, 40, 42 proximate work string 30 or may enter apparatuses 38, 40, 42 from annular region 48 via one or more inlets on the exterior of one or more of the apparatuses 38, 40, 42. These inlets may include pressure actuated devices, such as valves, rupture disks and the like disposed therein to regulate the flow of the fluid slurry therethrough.

Even though FIG. 1 depicts a vertical well, it should be noted by one skilled in the art that the apparatus for gravel packing an interval of a wellbore of the present invention is equally well-suited for use in deviated wells, inclined wells or horizontal wells. Also, even though FIG. 1 depicts an offshore operation, it should be noted by one skilled in the art that the apparatus for gravel packing an interval of a wellbore of the present invention is equally well-suited for use in onshore operations.

Figure 2:
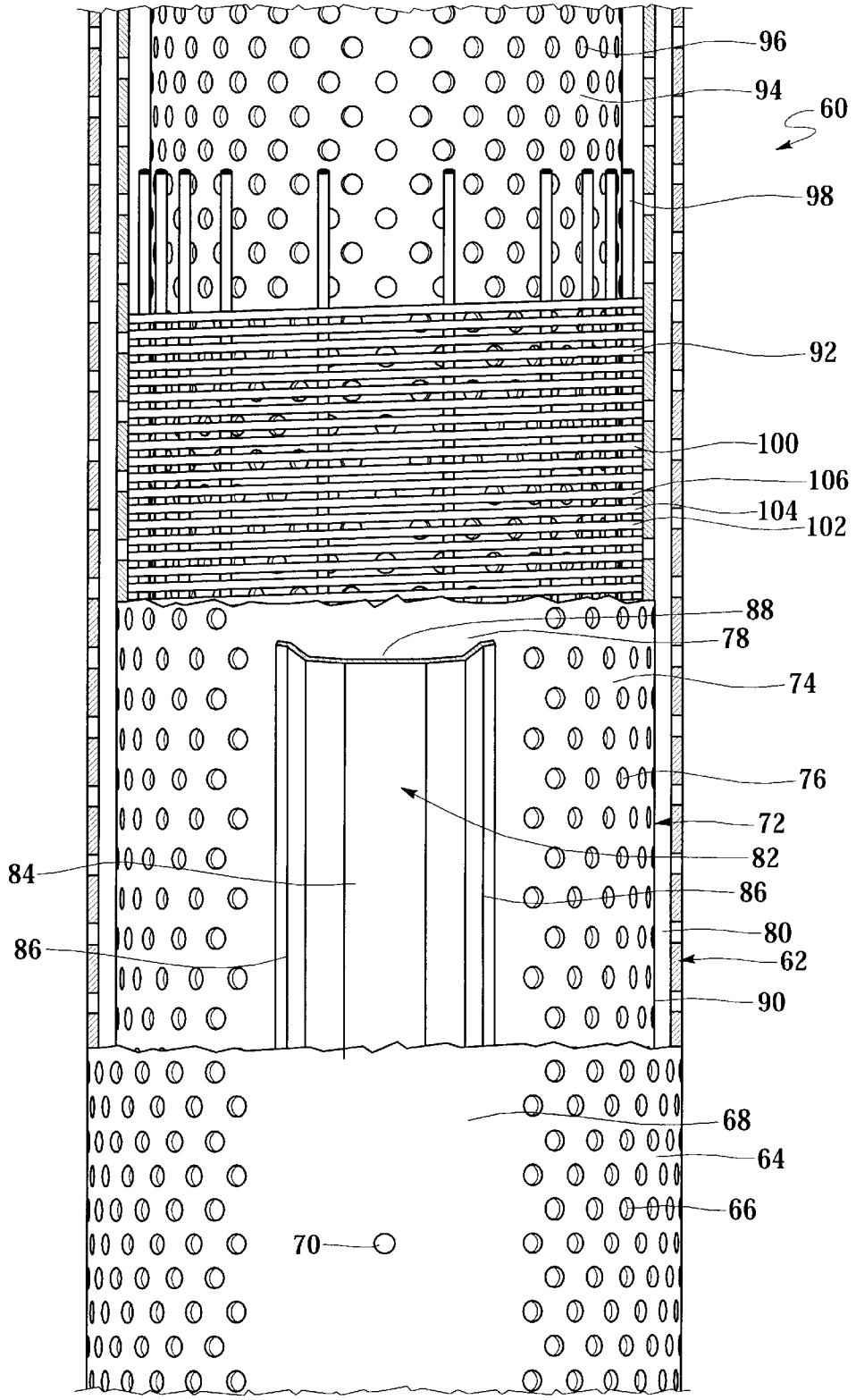
FIG. 2 is partial cut away view of an apparatus for gravel packing an interval of a wellbore of the present invention in position around a sand control screen.

Referring now to FIG. 2, therein is depicted a partial cut away view of an apparatus for gravel packing an interval of a wellbore of the present invention that is generally designated 60. Apparatus 60 has an outer tubular 62. A portion of the side wall of outer tubular 62 is an axially extending production section 64 that includes a plurality of openings 66. Another portion of the side wall of outer tubular 62 is an axially extending nonproduction section 68 that includes one or more outlets 70. For reasons that will become apparent to those skilled in the art, the density of opening 66 within production section 64 of outer tubular 62 is much greater than the density of outlets 70 in nonproduction section 68 of outer tubular 62. Also, it should be noted by those skilled in the art that even though FIG. 2 has depicted openings 66 and outlets 70 as being circular, other shaped openings may alternatively be used without departing from the principles of the present invention. Likewise, even though FIG. 2 has depicted openings 66 as being the same size as outlets 70, openings 66 could alternatively be larger or smaller than outlets 70 without departing from the principles of the present invention. In addition, the exact number, size and shape of openings 66 are not critical to the present invention, so long as sufficient area is provided for fluid production therethrough and the integrity of outer tubular 62 is maintained.

Disposed within outer tubular 62 is an inner tubular 72. A portion of the side wall of inner tubular 72 is an axially extending production section 74 that is substantially circumferentially aligned with production section 64 of outer tubular 62. Production section 74 of inner tubular 72 has a plurality of opening 76 therethrough. Again, the exact number, size and shape of openings 76 are not critical to the present invention, so long as sufficient area is provided for fluid production and the integrity of inner tubular 72 is maintained. Another portion of the side wall of inner tubular 72 is an axially extending nonproduction section 78 that is substantially circumferentially aligned with nonproduction section 68 of outer tubular 62. Nonproduction section 78 of inner tubular 72 has no openings therethrough.

Disposed within an annulus 80 between outer tubular 62 and inner tubular 72 is a channel 82. Channel 82 includes a web 84 and a pair of oppositely disposed sides 86 having ends that are attached to inner tubular 72 by, for example, welding or other suitable techniques. Channel 82 includes one or more outlets (not pictured) that are substantially aligned with outlets 70 of outer housing 64. Together, channel 82 and nonproduction section 78 of inner tubular 72 define a slurry passageway 88. A production pathway 90 is also defined having radial boundaries of production section 64 of outer tubular 62 and production section 74 of inner tubular 72. Slurry passageway 88 and production pathway 90 are in fluid isolation from one another.

Disposed within inner tubular 72 is a sand control screen 92. Sand control screen 92 includes a base pipe 94 that has a plurality of openings 96 which allow the flow of production fluids into the production tubing. The exact number, size and shape of openings 96 are not critical to the present invention, so long as sufficient area is provided for fluid production and the integrity of base pipe 94 is maintained.

Spaced around base pipe 94 is a plurality of ribs 98. Ribs 98 are generally symmetrically distributed about the axis of base pipe 94. Ribs 98 are depicted as having a cylindrical cross section, however, it should be understood by one skilled in the art that ribs 98 may alternatively have a rectangular or triangular cross section or other suitable geometry. Additionally, it should be understood by one skilled in the art that the exact number of ribs 98 will be dependent upon the diameter of base pipe 94 as well as other design characteristics that are well known in the art.

Wrapped around ribs 98 is a screen wire 100. Screen wire 100 forms a plurality of turns, such as turn 102, turn 104 and turn 106. Between each of the turns is a gap through which formation fluids flow. The number of turns and the gap between the turns are determined based upon the characteristics of the formation from which fluid is being produced and the size of the gravel to be used during the gravel packing operation. Together, ribs 98 and screen wire 100 may form a sand control screen jacket which is attached to base pipe 94 by welding or other suitable techniques.

It should be understood by those skilled in the art that while FIG. 2 has depicted a wire wrapped sand control screen, other types of filter media could alternatively be used in conjunction with the apparatus of the present invention, including, but not limited to, a fluid-porous, particulate restricting, sintered metal material such as a plurality of layers of a wire mesh that are sintered together to form a porous sintered wire mesh screen designed to allow fluid flow therethrough but prevent the flow of particulate materials of a predetermined size from passing therethrough.

Figure 3:
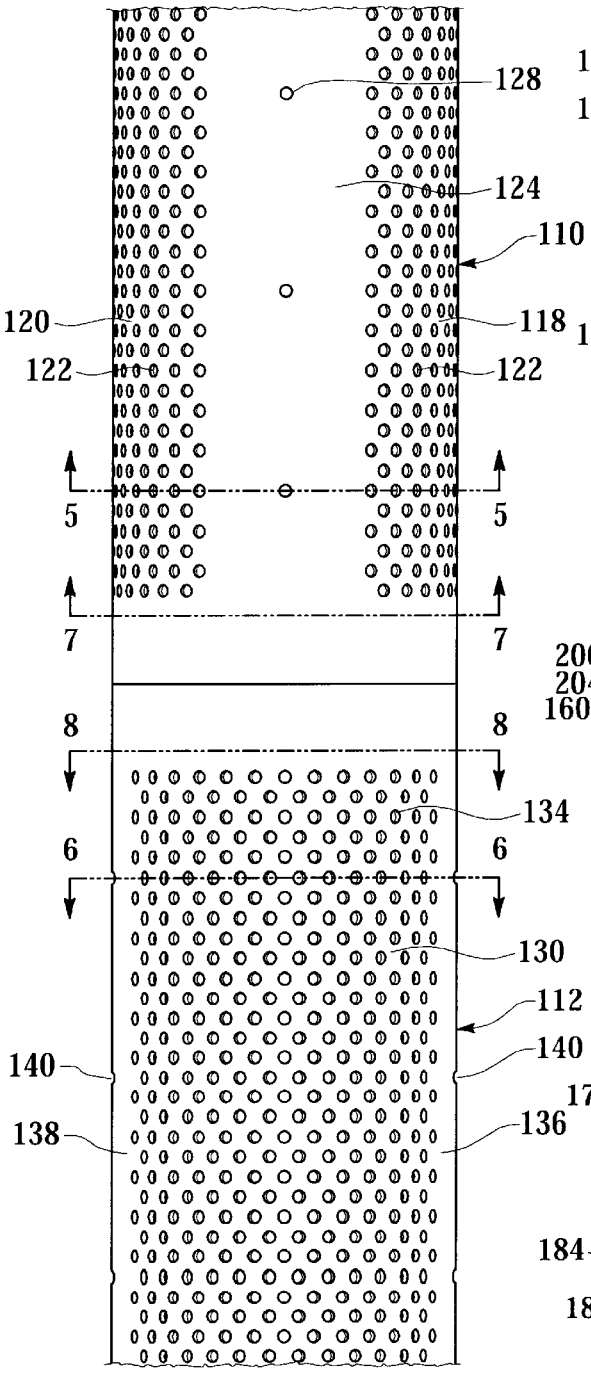
FIG. 3 is a side view of portions of two sections of an apparatus for gravel packing an interval of a wellbore of the present invention that are coupled together.
Figure 4:
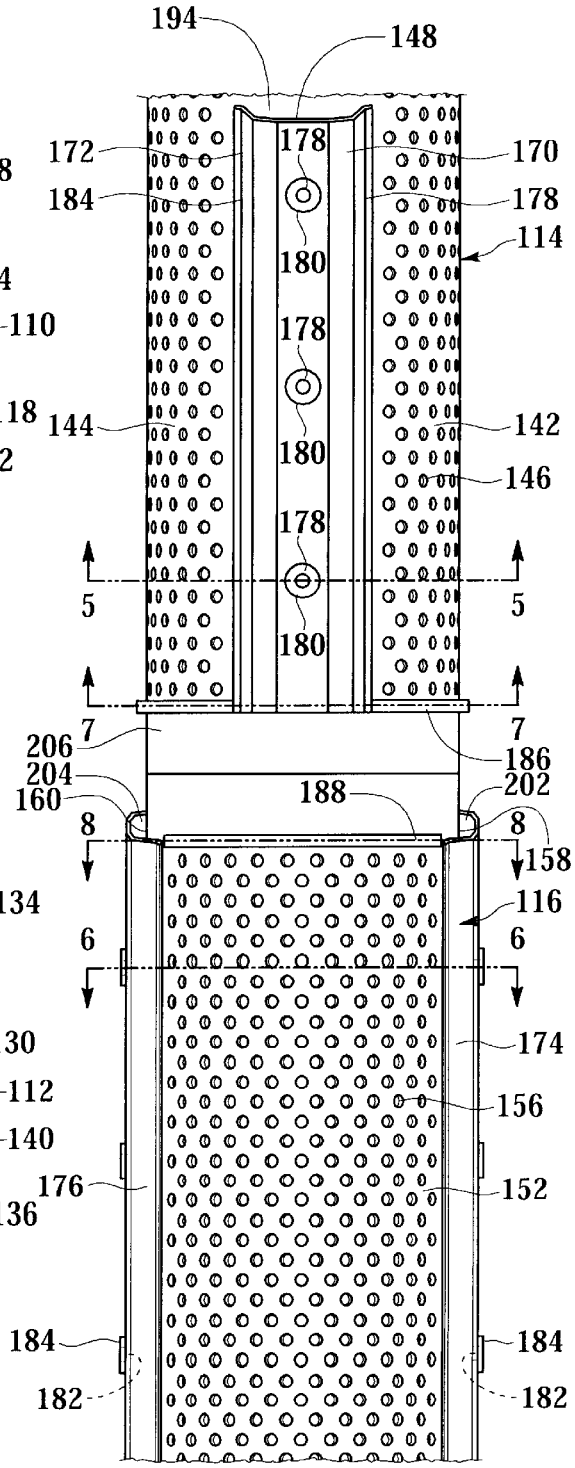
FIG. 4 is a side view of portions of two inner tubulars of an apparatus for gravel packing an interval of a wellbore of the present invention that are coupled together.

Referring now to FIGS. 3 and 4, therein are depicted portions of two sections of outer tubulars designated 110 and 112 and corresponding portions of two sections of inner tubulars designated 114 and 116, respectively. Outer tubular 110 has two axially extending production sections 118, 120 each including a plurality of openings 122. Outer tubular 110 also has two axially extending nonproduction sections 124, 126, only one of which is visible in FIG. 3. Each nonproduction section 124, 126 includes several outlets 128. Likewise, outer tubular 112 has two axially extending production sections 130, 132, only one of which is visible in FIG. 3. Each production section 130, 132 includes a plurality of openings 134. Outer tubular 112 also has two axially extending nonproduction sections 136, 138, each of which includes several outlets 140.

As should become apparent to those skilled in the art, even though FIG. 3 depicts outer tubular 110 and outer tubular 112 at a ninety-degree circumferential phase shift relative to one another, any degree of circumferential phase shift is acceptable using the present invention as the relative circumferential positions of adjoining sections of the apparatus for gravel packing an interval of a wellbore of the present invention does not affect the operation of the present invention. As such, the mating of adjoining sections of the apparatus for gravel packing an interval of a wellbore of the present invention is substantially similar to mating typical joints of pipe to form a pipe string requiring no special coupling tools or techniques.

Inner tubular 114 has two axially extending production sections 142, 144 each including a plurality of openings 146. Inner tubular 114 also has two axially extending nonproduction sections 148, 150, only one of which is visible in FIG. 4. There are no openings in nonproduction sections 148, 150. Likewise, inner tubular 116 has two axially extending production sections 152, 154, only one of which is visible in FIG. 4. Each production section 152, 154 includes a plurality of openings 156. Inner tubular 116 also has two axially extending nonproduction sections 158, 160, neither of which include any openings.

Figure 5:
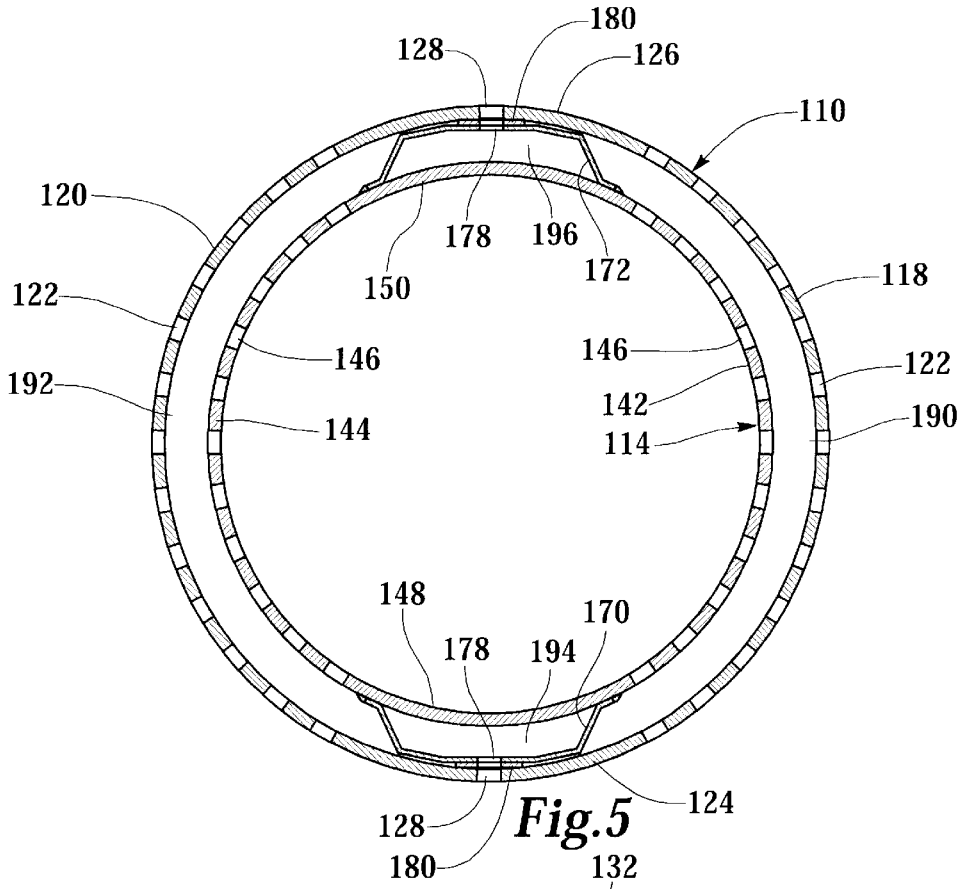
FIG. 5 is a cross sectional view of an apparatus for gravel packing an interval of a wellbore of the present invention taken along line 5—5 of FIGS. 3 and 4.
Figure 6:
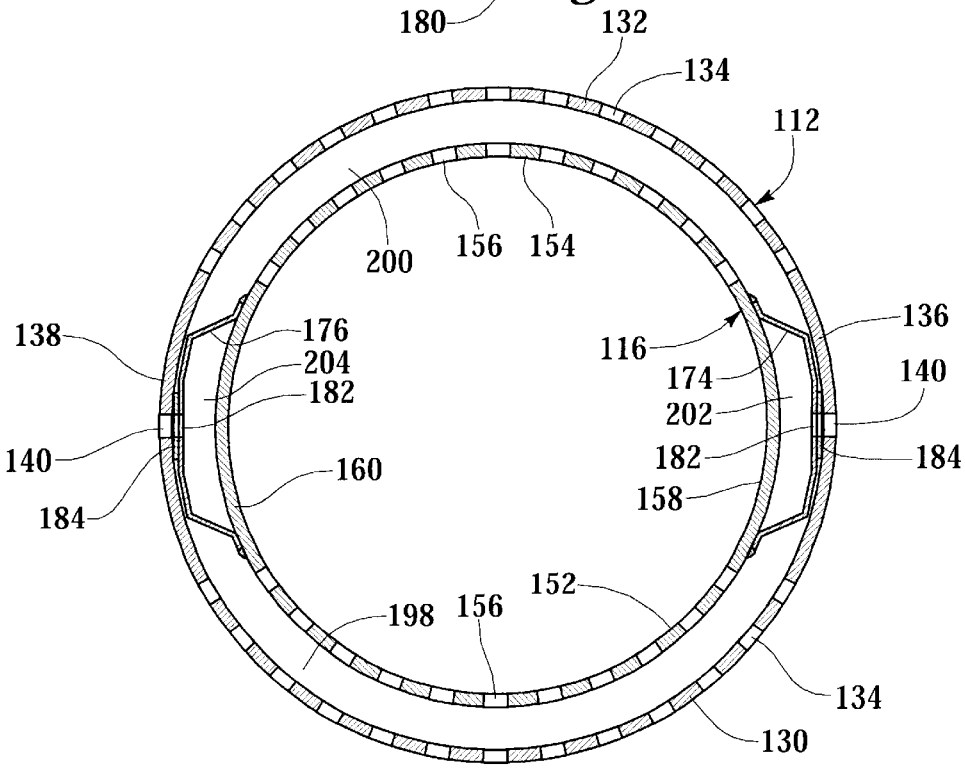
FIG. 6 is a cross sectional view of an apparatus for gravel packing an interval of a wellbore of the present invention taken along line 6—6 of FIGS. 3 and 4.

In the illustrated embodiment, inner tubulars 114, 116 would be positioned within outer tubulars 110, 112 such that production sections 118, 120 of outer tubular 110 are circumferentially aligned with production sections 142, 144 of inner tubular 114, as best seen in FIG. 5; such that nonproduction sections 124, 126 of outer tubular 110 are circumferentially aligned with nonproduction sections 148, 150 of inner tubular 114, also as best seen in FIG. 5; such that production sections 130, 132 of outer tubular 112 are circumferentially aligned with production sections 152, 154 of inner tubular 116, as best seen in FIG. 6; and such that nonproduction sections 136, 138 of outer tubular 112 are circumferentially aligned with nonproduction sections 158, 160 of inner tubular 116, also as best seen in FIG. 6.

Referring to FIGS. 4, 5 and 6, inner tubular 114 has a pair of channels 170, 172 attached thereto, only one of which is visible in FIG. 4. Likewise, inner tubular 116 has a pair of channels 174, 176 attached thereto. Channels 170, 172 includes a plurality of outlets 178 that substantially align with outlets 128 of outer tubular 110. Channels 170, 172 also include insert members 180 that provide a seal between outlets 128 and outlets 178. Likewise, channels 174, 176 have plurality of outlets 182 that are substantially aligned with outlets 140 of outer housing 112. Positioned between channels 174, 176 and outer housing 112 is a plurality of insert members 184 that provide a seal between outlets 182 and outlets 140.

Figure 7:
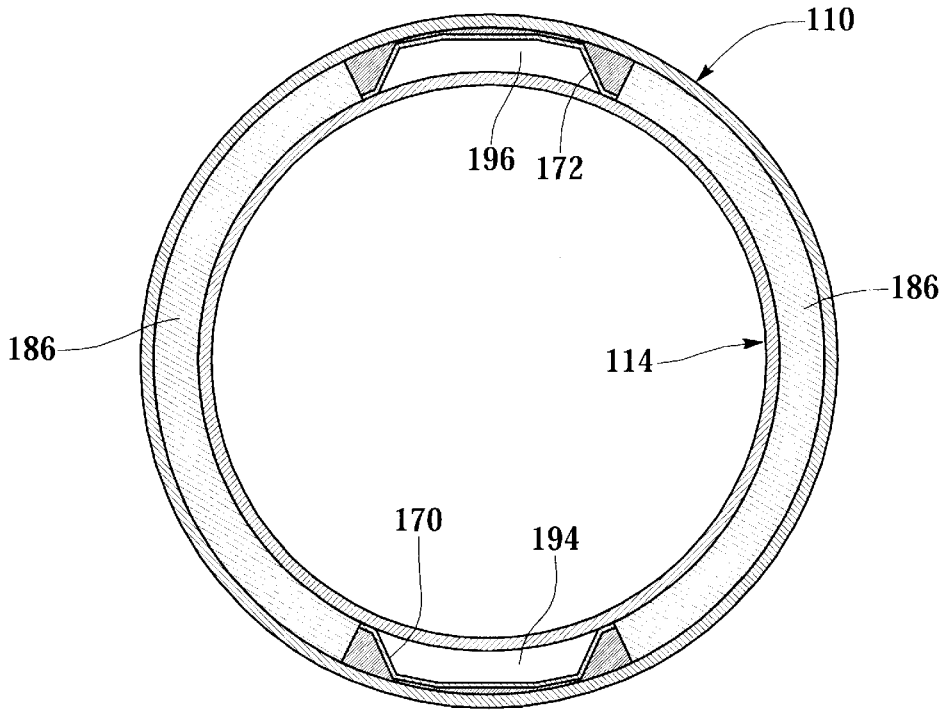
FIG. 7 is a cross sectional view of an apparatus for gravel packing an interval of a wellbore of the present invention taken along line 7—7 of FIGS. 3 and 4.
Figure 8:
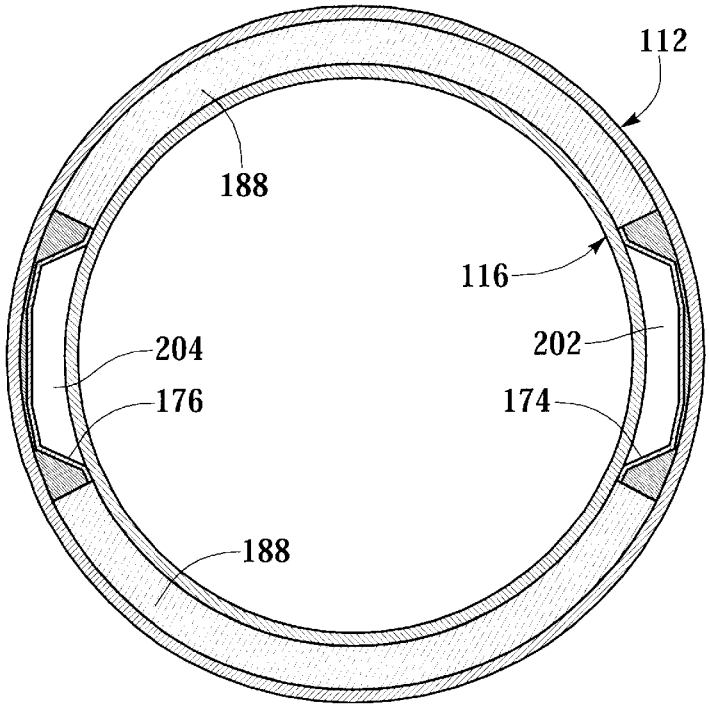
FIG. 8 is a cross sectional view of an apparatus for gravel packing an interval of a wellbore of the present invention taken along line 8—8 of FIGS. 3 and 4.

Each section of the apparatus of the present invention includes a pair of axially spaced apart substantially circumferential isolation members. For example, isolation members 186 are shown on inner tubular 114 in FIGS. 4 and 7. Likewise, isolation members 188 are shown on inner tubular 116 in FIGS. 4 and 8.

Channels 170, 172 define the circumferential boundaries of production pathways 190, 192 and, together with nonproduction sections 148, 150, channels 170, 172 define slurry passageways 194, 196. Isolation members 186 help provide fluid isolation between production pathways 190, 192 and slurry passageways 194, 196. Further, isolation members 186 provide complete fluid isolation for production pathways 190, 192.

Channels 174, 176 define the circumferential boundaries of production pathways 198, 200 and, together with nonproduction sections 158, 160, channels 174, 176 define slurry passageways 202, 204. Isolation members 188 help provide fluid isolation between production pathways 198, 200 and slurry passageways 202, 204. Further, isolation members 188 provide complete fluid isolation for production pathways 198, 200.

Importantly, however, slurry passageways 194, 196 and slurry passageways 202, 204 are all in fluid communication with one another such that a fluid slurry may travel in and between these passageways from one section of the apparatus for gravel packing an interval of a wellbore of the present invention to the next. Specifically, as best seen in FIGS. 3, 4, 7 and 8 collectively, an annular region 206 exists between outer tubulars 110, 112 and inner tubulars 114, 116 that allows the fluid slurry to travel downwardly from slurry passageways 194, 196 through annular regions 206 into slurry passageways 202, 204. As such, regardless of the circumferential orientation of inner tubular 114 relative to inner tubular 116, the fluid slurry will travel down through each section of the apparatus for gravel packing an interval of a wellbore of the present invention.

It should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. It should be noted, however, that the apparatus for gravel packing an interval of a wellbore is not limited to such orientation as it is equally-well suited for use in inclined and horizontal orientations.

Figure 9:
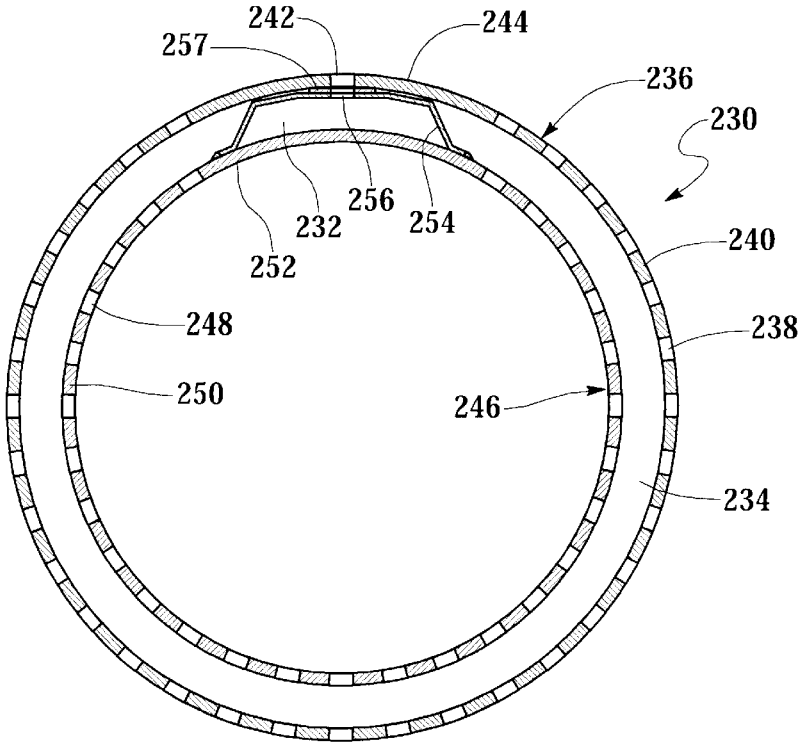
FIG. 9 is a cross sectional view of an alternate embodiment of an apparatus for gravel packing an interval of a wellbore of the present invention depicting one slurry passageway and one production pathway.
Figure 10:
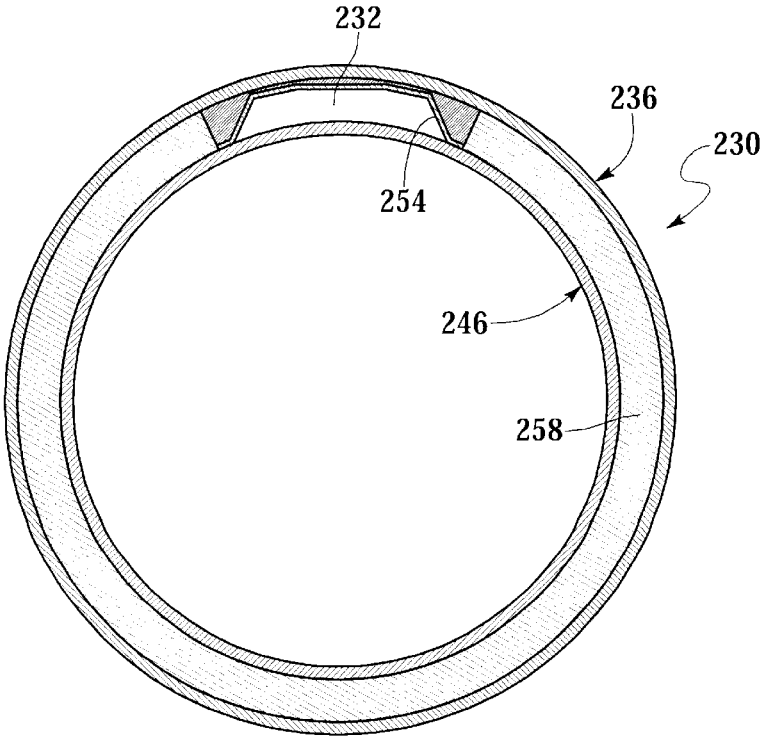
FIG. 10 is a cross sectional view of an alternate embodiment of an apparatus for gravel packing an interval of a wellbore of the present invention depicting one slurry passageway and an isolation member.

Referring now to FIGS. 9 and 10, therein are depicted cross sectional views of an alternate embodiment of an apparatus for gravel packing an interval of a wellbore that is generally designated 230. Apparatus 230 is similar to that shown in FIGS. 5 and 7 except apparatus 230 has a single slurry passageway 232 and a single production pathway 234. Specifically, apparatus 230 has an outer tubular 236 including a plurality of openings 238 in its production section 240 and a plurality of outlets 242 in its nonproduction section 244. Apparatus 230 also has an inner tubular 246 including a plurality of openings 248 in its production section 250 and no openings in its nonproduction section 252. A channel 254 is disposed between outer tubular 236 and inner tubular 246. Channel 254 is substantially aligned with nonproduction section 252 of inner tubular 246 and is preferably attached to inner tubular 246 by welding. Channel 254 has a plurality of outlets 256 that are substantially aligned with outlets 242 of outer tubular 236. An insert member 257 is disposed between outlets 256 and outlets 242 to provide a seal therebetween. An isolation member 258 provides fluid isolation between production pathway 234 and slurry passageway 232 and complete fluid isolation for production pathway 234.

Figure 11:
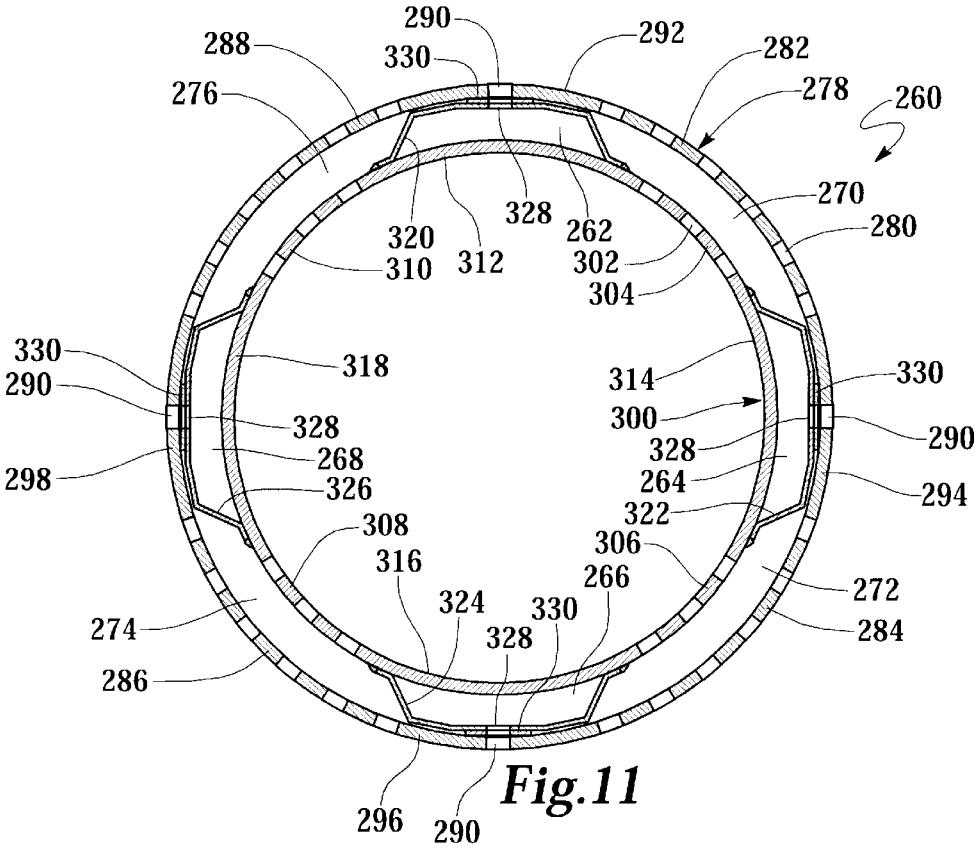
FIG. 11 is a cross sectional view of an alternate embodiment of an apparatus for gravel packing an interval of a wellbore of the present invention depicting four slurry passageways and four production pathways.
Figure 12:
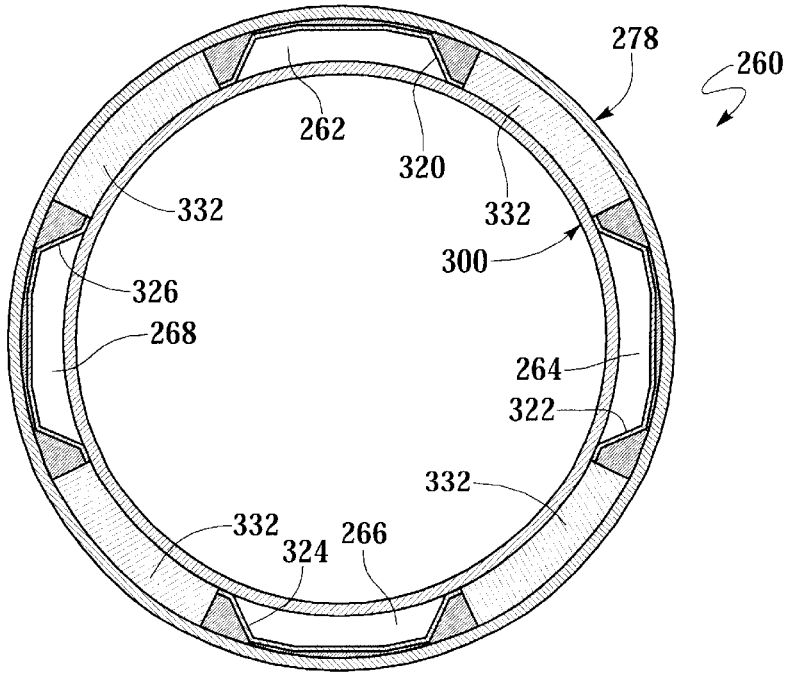
FIG. 12 is a cross sectional view of an alternate embodiment of an apparatus for gravel packing an interval of a wellbore of the present invention depicting four slurry passageways and an isolation member.

Referring now to FIGS. 11 and 12, therein are depicted cross sectional views of another embodiment of an apparatus for gravel packing an interval of a wellbore that is generally designated 260. Apparatus 260 is similar to that shown in FIGS. 5 and 7 except apparatus 260 has four slurry passageways 262, 264, 266, 268 and four production pathways 270, 272, 274, 276. Specifically, apparatus 260 has an outer tubular 278 including a plurality of openings 280 in its four production sections 282, 284, 286, 288 and a plurality of outlets 290 in its nonproduction sections 292, 294, 296, 298. Apparatus 260 also has an inner tubular 300 including a plurality of openings 302 in its production sections 304, 306, 308, 310 and no openings in its nonproduction sections 312, 314, 316, 318. Four channels 320, 322, 324, 326 are disposed between outer tubular 278 and inner tubular 300 which are substantially aligned with nonproduction sections 312, 314, 316, 318 of inner tubular 300 and are preferably welded thereto. Each channel 320, 322, 324, 326 has a plurality of outlets 328 that substantially align with outlets 290 of outer tubular 300. An insert member 330 is positioned between outlets 328 and outlets 290 to provide sealing. Isolation members 332 provide fluid isolation between production pathways 270, 272, 274, 276 and slurry passageways 262, 264, 266, 268 and complete fluid isolation for each of the production pathways 270, 272, 274 276.

As should be apparent from FIGS. 3–12, the apparatus for gravel packing an interval of a wellbore of the present invention may have a variety of configurations including configurations having one, two and four slurry passageways. Other configuration having other numbers of slurry passageways are also possible and are considered within the scope of the present invention.

In addition, it should be understood by those skilled in the art that use of various configurations of the apparatus for gravel packing an interval of a wellbore of the present invention in the same interval is likely and may be preferred. Specifically, it may be desirable to have a volumetric capacity within the slurry passageways that is greater toward the near end, top, in a vertical well, or heel, in an inclined or horizontal well, of a string of consecutive apparatuses of the present invention than toward the far end, the bottom or toe of the interval. This may be achieved by using apparatuses of the present invention having more slurry passageways proximate the near end of the interval and less slurry passageways proximate the far end of the interval. This may also be achieved by using apparatuses of the present invention having wider slurry passageways proximate the near end of the interval and narrower slurry passageways proximate the far end of the interval.

Figure 13:
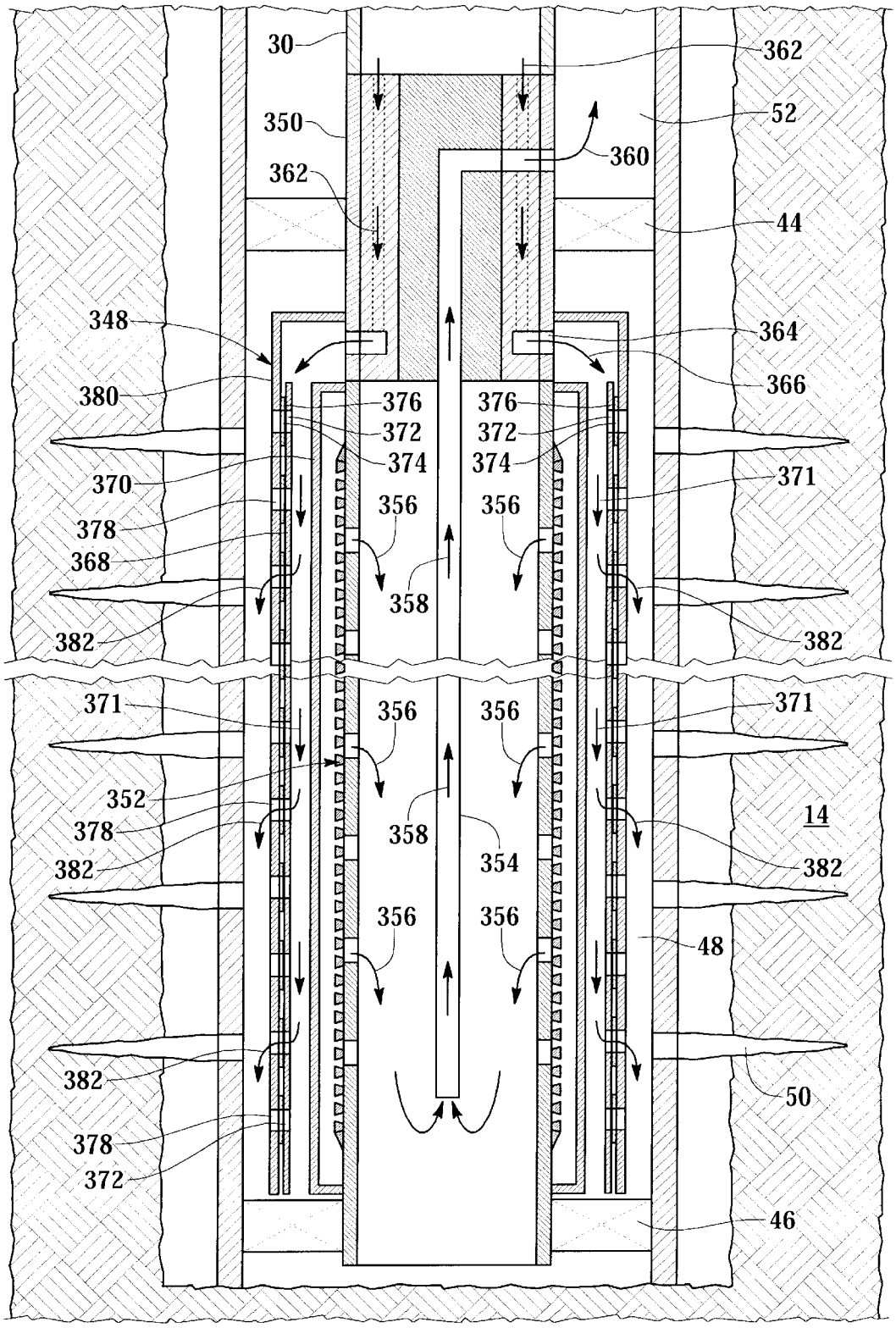
FIG. 13 is a half sectional view depicting the operation of an apparatus for gravel packing an interval of a wellbore of the present invention.

Referring now to FIG. 13, a typical completion process using an apparatus 348 for gravel packing an interval of a wellbore of the present invention will be described. First, interval 48 adjacent to formation 14 is isolated. Packer 44 seals the upper end of annular interval 48 and packer 46 seals the lower end of annular interval 48. Cross-over assembly 350 is located adjacent to screen assembly 352, traversing packer 44 with portions of cross-over assembly 350 on either side of packer 44. When the gravel packing operation commences, the objective is to uniformly and completely fill interval 48 with gravel. To help achieve this result, wash pipe 354 is disposed within screen assembly 352. Wash pipe 354 extends into cross-over assembly 350 such that return fluid passing through screen assembly 352, indicated by arrows 356, may travel through wash pipe 354, as indicated by arrow 358, and into annulus 52, as indicted by arrow 360, for return to the surface.

The fluid slurry containing gravel is pumped down work string 30 into cross-over assembly 350 along the path indicated by arrows 362. The fluid slurry containing gravel exits cross-over assembly 350 through cross-over ports 364 and is discharged into apparatus 348 as indicated by arrows 366. In the illustrated embodiment, the fluid slurry containing gravel then travels between channels 368 and the nonproduction sections of the inner tubular 370 as indicated by arrows 371. At this point, portions of the fluid slurry containing gravel exit apparatus 348 through outlets 372 of channels 368, outlets 374 of inserts 376 and outlets 378 of outer tubular 380, as indicated by arrows 382. As the fluid slurry containing gravel enters annular interval 48, the gravel drops out of the slurry and builds up from formation 14, filling perforations 50 and annular interval 48 around screen assembly 352 forming the gravel pack. Some of the carrier fluid in the slurry may leak off through perforations 50 into formation 14 while the remainder of the carrier fluid passes through screen assembly 352, as indicated by arrows 356, that is sized to prevent gravel from flowing therethrough. The fluid flowing back through screen assembly 352, as explained above, follows the paths indicated by arrows 358, 360 back to the surface.

In operation, the apparatus for gravel packing an interval of a wellbore of the present invention is used to distribute the fluid slurry to various locations within the interval to be gravel packed by injecting the fluid slurry into the slurry passageways created by the channels and the inner tubular of one or more sections of the apparatus. The fluid slurry exits through the various outlets along the slurry passageway and enters the annulus between the apparatus and the wellbore which may be cased or uncased. Once in this annulus, a portion of the gravel in the fluid slurry is deposited around the apparatus in the annulus such that the gravel migrates both circumferentially and axially from the outlets. This process progresses along the entire length of the apparatus such that the annular area becomes completely packed with the gravel. In addition, a portion of the fluid slurry enters the opening in the production sections of the outer tubular which provides for the deposit of a portion of the gravel from the fluid slurry in the production pathways between the outer tubular and the inner tubular. Again, this process progresses along the entire length of the apparatus such that each production pathway becomes completely packed with the gravel. Once both the annulus and the production pathways are completely packed with gravel, the gravel pack operation may cease.

Figure 14:
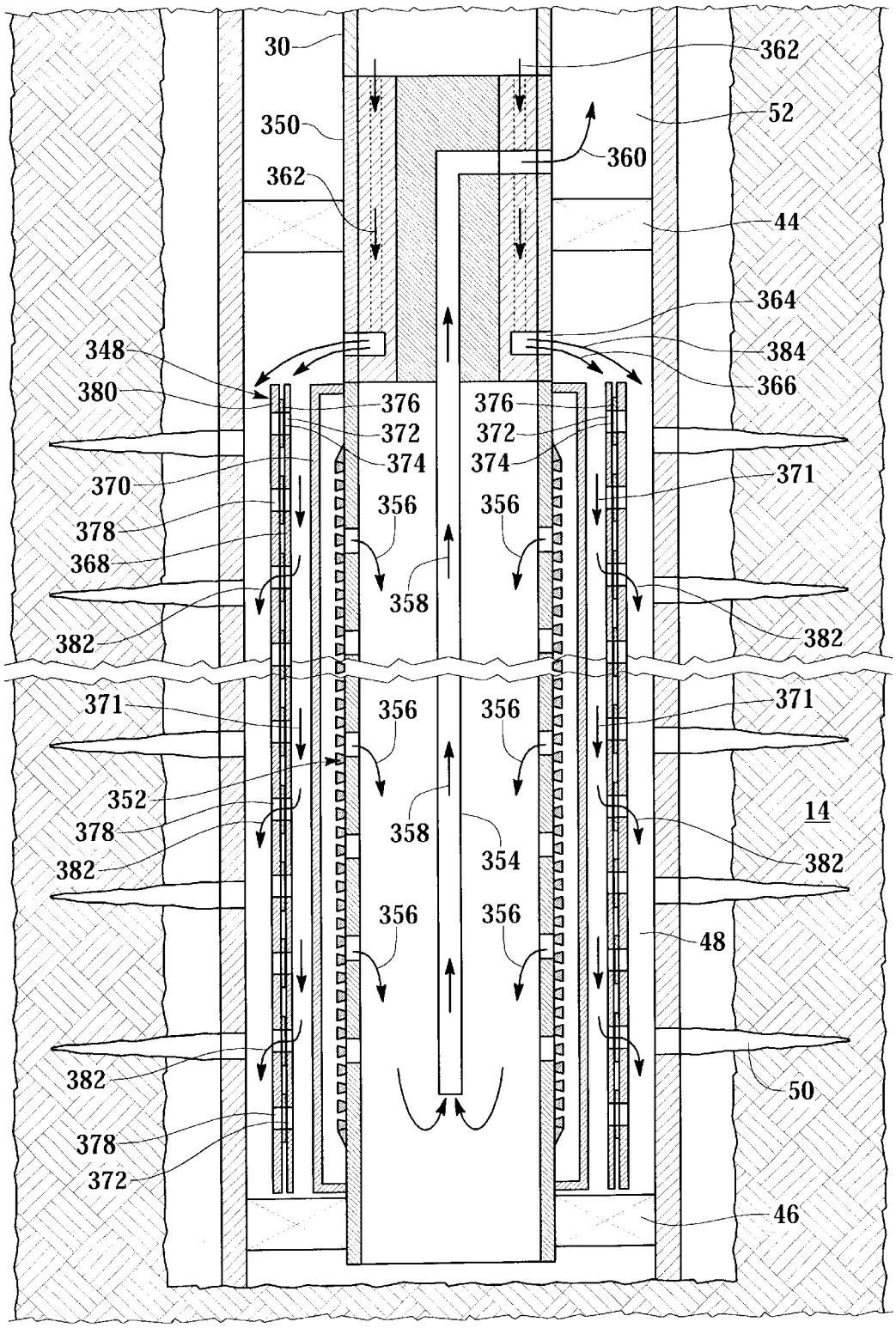
FIG. 14 is a half sectional view depicting the operation of another embodiment of an apparatus for gravel packing an interval of a wellbore of the present invention.

In some embodiments of the present invention, the fluid slurry may not initially be injected into the slurry passageways. Instead, the fluid slurry is injected directly into the annulus between the apparatus and the wellbore, as best seen in FIG. 14. In the illustrated embodiment, the primary path for the fluid slurry containing gravel as it is discharged from exit ports 364, is directly into annular interval 48 as indicated by arrows 384. This is the primary path as the fluid slurry seeks the path of least resistance. Under ideal conditions, the fluid slurry travels throughout the entire interval 48 until interval 48 is completely packed with gravel. In addition, the fluid slurry enters the production pathways of apparatus 348 such that this area is also completely packed with gravel.

It has been found, however, that sand bridges commonly form during the gravel packing of an interval when the fluid slurry is pumped directly into annular interval 48. These sand bridges are bypassed using the apparatus for gravel packing an interval of a wellbore of the present invention by first allowing the fluid slurry to pass through the outer tubular into the production pathways of apparatus 348, bypassing the sand bridge and then returning to annular interval 48 through the outer tubular to complete the gravel packing process. These pathways are considered the secondary path for the fluid slurry. If a sand bridge forms in the secondary paths prior to completing the gravel packing operation, then the fluid slurry enters channels 368 as indicated by arrows 366 and as described above with reference to FIG. 13. In this embodiment, channels 368 are considered the tertiary path for the fluid slurry.

In either embodiment, once the gravel pack is completed and the well is brought on line, formation fluids that are produced into the gravel packed interval must travel through the gravel pack in the annulus, then enter the production pathways through the openings in the outer tubular where the formation fluids pass through the gravel pack between the outer tubular and the screen assembly. As such, the apparatus for gravel packing an interval of a wellbore of the present invention allows for a complete gravel pack of an interval so that particulate materials in the formation fluid are filtered out.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for gravel packing an interval of a wellbore, the apparatus comprising:

an outer tubular having an axially extending production section with a plurality of openings and an axially extending nonproduction section with a plurality of outlets;

an inner tubular disposed within the outer tubular forming an annulus therebetween, the inner tubular having an axially extending production section that is substantially circumferentially aligned with the production section of the outer tubular and an axially extending nonproduction section that is substantially circumferentially aligned with the nonproduction section of the outer tubular, the production section of the inner tubular having a plurality of openings, the nonproduction section of the inner tubular having no openings, the production sections of the outer and inner tubulars forming a production pathway therebetween; and a channel having a plurality of outlets disposed within the annulus and substantially circumferentially aligned with the nonproduction section of the inner tubular forming a slurry passageway therewith, the outlets of the channel substantially aligned with the outlets of the outer tubular.

2. The apparatus as recited in claim 1 wherein the channel further comprises a web and a pair of oppositely disposed sides.

3. The apparatus as recited in claim 1 further comprising insert members disposed between the channel and the outer tubular, the insert members having openings that substantially aligned with the outlets of the channel and the outlets of the outer tubular.

4. The apparatus as recited in claim 1 wherein the channel is sealably attached to the inner tubular.

5. The apparatus as recited in claim 1 further comprising a sand control screen disposed within the inner tubular.

6. The apparatus as recited in claim 1 wherein the inner and outer tubulars each further comprise first and second axially extending production sections and first and second axially extending nonproduction sections and wherein the apparatus further comprises first and second channels that are substantially circumferentially aligned with the first and second nonproduction sections of the inner tubular, respectively, forming first and second slurry passageways therewith.

7. The apparatus as recited in claim 1 wherein the inner and outer tubulars each further comprise first, second, third and fourth axially extending production sections and first, second, third and fourth axially extending nonproduction sections and wherein the apparatus further comprises first, second, third and fourth channels that are substantially circumferentially aligned with the first, second, third and fourth nonproduction sections of the inner tubular, respectively, forming first, second, third and fourth slurry passageways therewith.

8. An apparatus for gravel packing an interval of a wellbore, the apparatus comprising an outer tubular forming a first annulus with the wellbore and an inner tubular disposed within the outer tubular forming a second annulus therebetween, the second annulus including an axially extending production pathway and an axially extending slurry passageway defined between a channel and the inner tubular, a portion of the outer tubular adjacent the slurry passageway having outlets that are substantially aligned with outlets of the channel, a portion of both the outer and inner tubulars adjacent the production pathway having a plurality of openings, the slurry passageway being in fluid isolation from the production pathway such that when a fluid slurry containing gravel is injected through the slurry passageway, the fluid slurry exits the apparatus through the outlets of the channel and the outlets of the outer tubular leaving a first portion of the gravel in the first annulus then enters the openings in the outer tubular leaving a second portion of the gravel in the production pathway and such that when formation fluids are produced, the formation fluids enter the production pathway through the openings in the outer tubular and exit the production pathway through the openings in the inner tubular passing through the first and second portions of the gravel.

9. The apparatus as recited in claim 8 wherein the channel further comprises a web and a pair of oppositely disposed sides.

10. The apparatus as recited in claim 8 further comprising insert members disposed between the channel and the outer tubular, the insert members having openings that are substantially aligned with the outlets of the channel and the outlets of the outer tubular.

11. The apparatus as recited in claim 8 wherein the channel is sealably attached to the inner tubular.

12. The apparatus as recited in claim 8 further comprising a sand control screen disposed within the inner tubular.

13. The apparatus as recited in claim 8 wherein the inner and outer tubulars each further comprise first and second axially extending production sections and first and second axially extending nonproduction sections and wherein the apparatus further comprises first and second channels that are substantially circumferentially aligned with the first and second nonproduction sections of the inner tubular, respectively, forming first and second slurry passageways therewith.

14. The apparatus as recited in claim 8 wherein the inner and outer tubulars each further comprise first, second, third and fourth axially extending production sections and first, second, third and fourth axially extending nonproduction sections and wherein the apparatus further comprises first, second, third and fourth channels that are substantially circumferentially aligned with the first, second, third and fourth nonproduction sections of the inner tubular, respectively, forming first, second, third and fourth slurry passageways therewith.

15. An apparatus for gravel packing an interval of a wellbore, the apparatus comprising:

an inner tubular having an axially extending production section and an axially extending nonproduction section;

an outer tubular disposed around the inner tubular forming a first annulus therewith and a second annulus with the wellbore, the outer tubular having an axially extending production section and an axially extending nonproduction;

a slurry passageway formed within the first annulus that is substantially circumferentially aligned with the nonproduction section of the inner tubular; and a production pathway formed within the first annulus that is substantially circumferentially aligned with the production sections of the inner and outer tubulars, wherein, when the apparatus is in an operable position, the second annulus serves as a primary path for delivery of a fluid slurry, the production pathway serves as a secondary path for delivery of the fluid slurry when the primary path becomes blocked and the slurry passageway serves as a tertiary path for delivery of the fluid slurry when the primary and secondary paths become blocked.

16. The apparatus as recited in claim 15 wherein the slurry passageway is formed between a channel and the nonproduction section of the inner tubular.

17. The apparatus as recited in claim 16 wherein the channel further comprises a web and a pair of oppositely disposed sides.

18. The apparatus as recited in claim 16 further comprising insert members disposed between the channel and the outer tubular, the insert members having openings that are substantially aligned with outlets of the channel and outlets of the outer tubular.

19. The apparatus as recited in claim 16 wherein the channel is sealably attached to the inner tubular.

20. The apparatus as recited in claim 15 further comprising a sand control screen disposed within the inner tubular.

21. The apparatus as recited in claim 15 wherein the inner and outer tubulars each further comprise first and second axially extending production sections and first and second axially extending nonproduction sections and wherein the apparatus further comprises first and second slurry passageways and first and second production pathways.

22. The apparatus as recited in claim 21 wherein the first and second slurry passageways are formed between first and second channels and the first and second nonproduction sections of the inner tubular.

23. The apparatus as recited in claim 15 wherein the inner and outer tubulars each further comprise first, second, third and fourth axially extending production sections and first, second, third and fourth axially extending nonproduction sections and wherein the apparatus further comprises first, second, third and fourth slurry passageways and first, second, third and fourth production pathways.

24. The apparatus as recited in claim 23 wherein the first, second, third and fourth slurry passageways are formed between first, second, third and fourth channels and the first, second, third and fourth nonproduction sections of the inner tubular.

25. A method for gravel packing an interval of a wellbore, the method comprising the steps of:

traversing a formation with the wellbore;

locating a sand control screen and a gravel packing apparatus within the wellbore proximate the formation, the gravel packing apparatus positioned around the sand control screen, the gravel packing apparatus forming a first annulus with the wellbore, the gravel packing apparatus comprising an outer tubular and an inner tubular disposed within the outer tubular forming a second annulus therebetween, the second annulus including an axially extending production pathway and an axially extending slurry passageway defined between a channel and the inner tubular, the slurry passageway being in fluid isolation from the production pathway; and injecting a fluid slurry containing gravel through the slurry passageway such that the fluid slurry exits the slurry passageway through outlets in the channel, which are substantially aligned with outlets in the outer tubular, leaving at least a portion of the gravel in the first annulus.

26. The method as recited in claim 25 wherein the channel further comprises a web and a pair of oppositely disposed sides.

27. The method as recited in claim 25 further comprising the step of positioning insert members between the channel and the outer tubular, the insert members having openings that are substantially aligned with the outlets of the channel and the outlets of the outer tubular.

28. The method as recited in claim 25 further comprising the step of sealably attaching the channel to the inner tubular.

29. The method as recited in claim 25 wherein the step of injecting a fluid slurry containing gravel through the slurry passageway further comprises injecting the fluid slurry containing gravel through first and second slurry passageways.

30. The method as recited in claim 25 wherein the step of injecting a fluid slurry containing gravel through the slurry passageway further comprises injecting the fluid slurry containing gravel through first, second, third and fourth slurry passageways.

31. A method for gravel packing an interval of a wellbore, the method comprising the steps of:

traversing a formation with the wellbore;

locating a sand control screen and a gravel packing apparatus within the wellbore proximate the formation, the gravel packing apparatus positioned around the sand control screen, the gravel packing apparatus forming a first annulus with the wellbore, the gravel packing apparatus comprising an outer tubular and an inner tubular disposed within the outer tubular forming a second annulus therebetween, the second annulus including an axially extending production pathway and an axially extending slurry passageway defined between a channel and the inner tubular, the slurry passageway being in fluid isolation from the production pathway;

injecting a fluid slurry containing gravel through the slurry passageway such that the fluid slurry exits the slurry passageway through outlets in the channel, which are substantially aligned with outlets in the outer tubular, into the first annulus;

depositing a first portion of the gravel in the first annulus; and depositing a second portion of the gravel in the production pathway by returning a portion of the fluid slurry through openings in the outer tubular.

32. The method as recited in claim 31 wherein the channel further comprises a web and a pair of oppositely disposed sides.

33. The method as recited in claim 31 further comprising the step of positioning insert members between the channel and the outer tubular, the insert members having openings that are substantially aligned with the outlets of the channel and the outlets of the outer tubular.

34. The method as recited in claim 31 further comprising the step of sealably attaching the channel to the inner tubular.

35. The method as recited in claim 31 wherein the step of injecting a fluid slurry containing gravel through the slurry passageway further comprises injecting the fluid slurry containing gravel through first and second slurry passageways.

36. The method as recited in claim 31 wherein the step of injecting a fluid slurry containing gravel through the slurry passageway further comprises injecting the fluid slurry containing gravel through first, second, third and fourth slurry passageways.

37. A method for gravel packing an interval of a wellbore, the method comprising the steps of:

traversing a formation with the wellbore;

locating a sand control screen and a gravel packing apparatus within the wellbore proximate the formation, the gravel packing apparatus positioned around the sand control screen, the gravel packing apparatus forming a first annulus with the wellbore, the gravel packing apparatus comprising an outer tubular and an inner tubular disposed within the outer tubular forming a second annulus therebetween;

forming a slurry passageway within the second annulus that is substantially circumferentially aligned with a nonproduction section of the inner tubular;

forming a production pathway within the second annulus that is substantially circumferentially aligned with production sections of the inner and outer tubulars;

injecting a fluid slurry containing gravel into a primary path defined by the first annulus;

diverting the fluid slurry containing gravel into a secondary path defined by the production pathway if the primary path becomes blocked; and diverting the fluid slurry containing gravel into a tertiary path defined by the slurry passageway if the primary and secondary paths become blocked.

38. The method as recited in claim 37 further comprising the step of disposing a channel within the second annulus that defines the slurry passageway with the inner tubular.

39. The method as recited in claim 38 wherein the channel further comprises a web and a pair of oppositely disposed sides.

40. The method as recited in claim 38 further comprising the step of positioning insert members between the channel and the outer tubular, the insert members having openings that are substantially aligned with the outlets of the channel and the outlets of the outer tubular.

41. The method as recited in claim 38 further comprising the step of sealably attaching the channel to the inner tubular.

42. The method as recited in claim 37 wherein the step of diverting the fluid slurry containing gravel into a tertiary path defined by the slurry passageway if the primary and secondary paths become blocked further comprises diverting the fluid slurry containing gravel into first and second slurry passageways.

43. The method as recited in claim 37 wherein the step of diverting the fluid slurry containing gravel into a tertiary path defined by the slurry passageway if the primary and secondary paths become blocked further comprises diverting the fluid slurry containing gravel into first, second, third and fourth slurry passageways.

44. An apparatus for gravel packing an interval of a wellbore, the apparatus comprising:

an outer tubular disposed within the wellbore; and an inner tubular disposed within the outer tubular forming an axially extending production pathway and an axially extending slurry passageway therebetween, a portion of the outer tubular adjacent the slurry passageway having outlets, a portion of both the outer and inner tubulars adjacent the production pathway having a plurality of openings, the slurry passageway being in fluid isolation from the production pathway such that when a fluid slurry containing gravel is injected through the slurry passageway, the fluid slurry exits the apparatus through the outlets of the outer tubular leaving a first portion of the gravel in the region between the outer tubular and the wellbore then enters the openings in the outer tubular leaving a second portion of the gravel in the production pathway.

45. The apparatus as recited in claim 44 wherein the slurry passageway is defined between a channel and a nonproduction section of the inner tubular.

46. The apparatus as recited in claim 45 wherein the channel has outlets that are substantially aligned with the outlets of the outer tubular.

47. The apparatus as recited in claim 44 wherein the production pathway is positioned between production sections of the inner and outer tubulars.

48. An apparatus for gravel packing an interval of a wellbore, the apparatus comprising:

an outer tubular disposed within the wellbore;

an inner tubular disposed within the outer tubular;

a slurry passageway formed between the inner and outer tubulars; and a production pathway formed between the inner and outer tubulars, wherein, when the apparatus is in an operable position, the region between the outer tubular and the wellbore serves as a primary path for delivery of a fluid slurry, the production pathway serves as a secondary path for delivery of the fluid slurry if the primary path becomes blocked and the slurry passageway serves as a tertiary path for delivery of the fluid slurry if the primary and secondary paths become blocked.

49. The apparatus as recited in claim 48 wherein the slurry passageway is defined between a channel and a nonproduction section of the inner tubular.

50. The apparatus as recited in claim 49 wherein the channel has outlets that are substantially aligned with outlets of the outer tubular.

51. The apparatus as recited in claim 48 wherein the production pathway is positioned between production sections of the inner and outer tubulars.

52. A method for gravel packing an interval of a wellbore, the method comprising the steps of:

locating a gravel packing apparatus within the wellbore, the gravel packing apparatus including an outer tubular and an inner tubular disposed within the outer tubular forming an axially extending production pathway and an axially extending slurry passageway therebetween that are in fluid isolation from one another;

injecting a fluid slurry containing gravel through the slurry passageway such that the fluid slurry exits the slurry passageway through outlets in the outer tubular;

depositing a first portion of the gravel in the region between the outer tubular and the wellbore; and depositing a second portion of the gravel in the production pathway by returning a portion of the fluid slurry through openings in the outer tubular.

53. A method for gravel packing an interval of a wellbore, the method comprising the steps of:

locating a gravel packing apparatus within the wellbore, the gravel packing apparatus including an outer tubular and an inner tubular disposed within the outer tubular forming an axially extending production pathway and an axially extending slurry passageway therebetween that are in fluid isolation from one another;

injecting a fluid slurry containing gravel into a primary path defined by the region between the outer tubular and the wellbore;

diverting the fluid slurry containing gravel into a secondary path defined by the production pathway if the primary path becomes blocked; and diverting the fluid slurry containing gravel into a tertiary path defined by the slurry passageway if the primary and secondary paths become blocked.

* * * * *

UNITED STATES PATENT AND TRADEMARK OFFICE

CERTIFICATE OF CORRECTION

PATENT NO. : 6,702,018 B2
DATED : March 9, 2004
INVENTOR(S) : Ronald W. McGregory et al.

It is certified that error appears in the above-identified patent and that said Letters Patent is hereby corrected as shown below:

Title page,
Item [75], Inventors, "Robert L. Crow" should read -- Robert W. Crow --.

Signed and Sealed this

Thirty-first Day of January, 2006

JON W. DUDAS
*Director of the United States Patent and Trademark Office*